United States Patent [19]

Chernock

[11] 3,953,996

[45] May 4, 1976

[54] SPARK WHEELS, METHOD OF MANUFACTURING SPARK WHEELS, AND DIES FOR USE THEREIN

[76] Inventor: Stephen P. Chernock, Flax Mill Lane, Milford, Conn. 06460

[22] Filed: Sept. 25, 1974

[21] Appl. No.: 509,298

Related U.S. Application Data

[62] Division of Ser. No. 431,062, Jan. 7, 1974, Pat. No. 3,910,751.

[52] U.S. Cl. ..... 72/90; 72/103; 72/102; 72/469

[51] Int. Cl.[2] ..... B21H 1/02; B21H 7/14

[58] Field of Search ..... 72/88, 89, 90, 469, 72/102, 103; 431/276, 273; 76/101 R, 101 A, 24; 29/78

[56] References Cited

UNITED STATES PATENTS

| | | | |
|---|---|---|---|
| 368,688 | 8/1887 | Rogers | 72/88 |
| 446,739 | 2/1891 | Jones | 72/88 |
| 2,232,336 | 2/1941 | Meersteiner | 72/90 X |
| 2,232,337 | 2/1941 | Meersteiner | 72/88 |
| 2,293,930 | 8/1942 | Braedel | 72/88 X |
| 3,039,334 | 6/1962 | Kohler | 72/103 X |
| 3,602,027 | 8/1971 | Klug | 29/157.3 AH |
| 3,742,753 | 7/1973 | Biesenbach | 76/101 A |

*Primary Examiner*—Milton S. Mehr
*Attorney, Agent, or Firm*—Mattern, Ware, Davis & Stoltz

[57] ABSTRACT

By forming a plurality of substantially parallel grooves in the peripheral surface of a cylindrical spark wheel blank, and then rolling the grooved spark wheel blank between at least two cooperating dies, an inexpensive, unique spark wheel is rapidly and efficiently formed having a multitude of ramp top surfaces terminating in raised sharp cutting edges and burrs throughout its outer peripheral surface. The spark wheel blank must rotate between the dies sufficiently to impart the desired abrasive characterisic to the spark wheel surface. The dies employed in the process of this invention must incorporate either a plurality of cutting edges which are spaced closely enough to prevent the spark wheel from bottoming out on the die during the rolling step or relief channels at the base of each cutting surface which prevent destruction of the abrasive spark wheel surface.

19 Claims, 10 Drawing Figures

FIG. 1
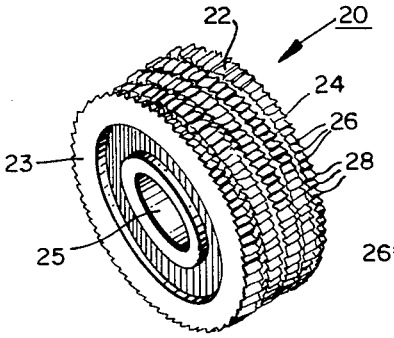
FIG. 2
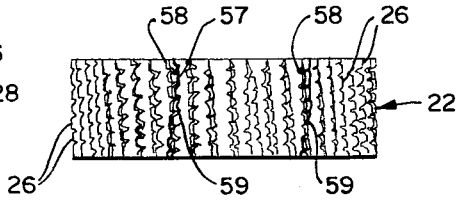
FIG. 3
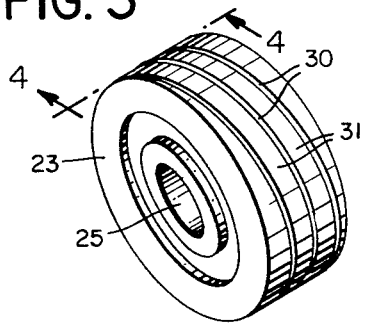
FIG. 4
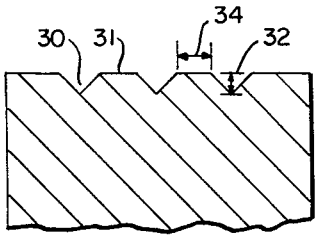
FIG. 6
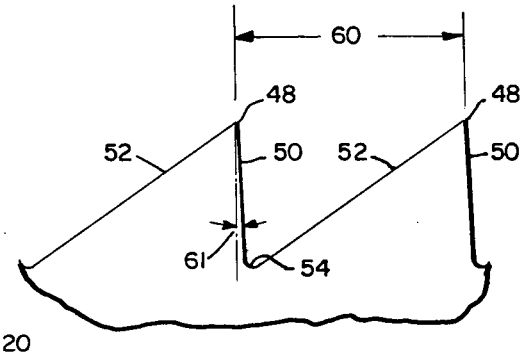
FIG. 5
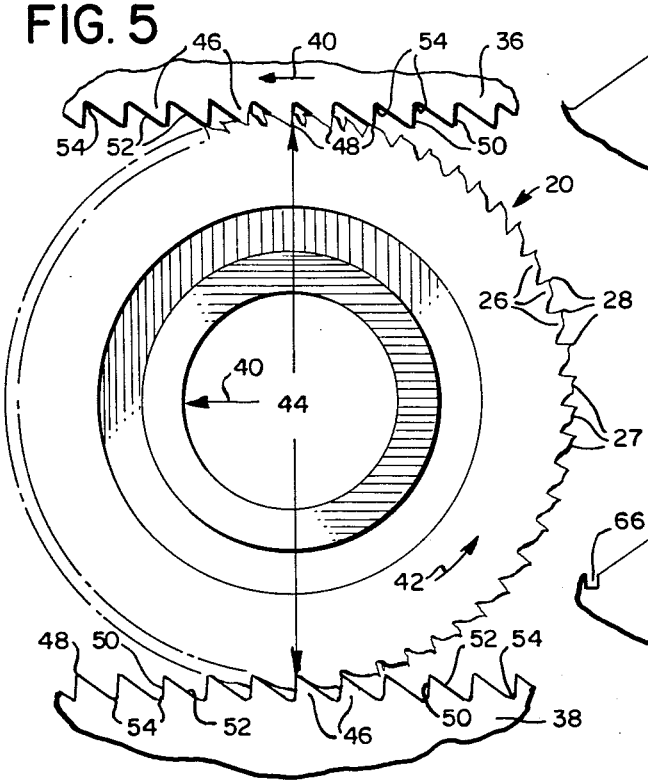
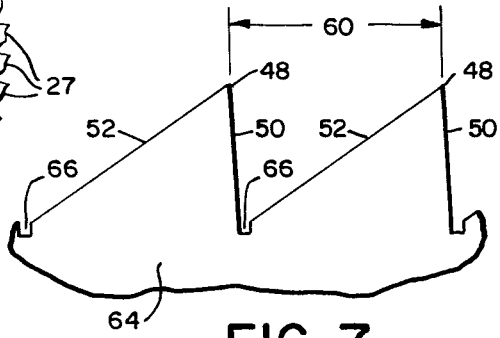
FIG. 7

SPARK WHEELS, METHOD OF MANUFACTURING SPARK WHEELS, AND DIES FOR USE THEREIN

This is a division, of application Ser. No. 431,062, filed 1/17/74 now U.S. Pat. No. 3,910,751.

BACKGROUND OF THE INVENTION

This invention relates to spark wheels for use in cigarette lighters and the like, and more particularly to a method for manufacturing the abrasive surface for the spark wheel and dies for use in the process.

In order to properly function, a spark wheel must incorporate an abrasive surface which, when rotated against a flint of similar pyrophoric material, will produce a spark to ignite a fuel-fed wick or jet of flammable gas. As is well known in the art, before the abrasive surface can be formed, substantially parallel grooves must be formed in the cylindrical surface of the wheel blank at an acute angle to the sides of the wheel in order to provide the proper offset spacing for the cutting edges of the spark wheel.

The two well-known prior art methods for producing the desired abrasive surface for the spark wheel are chiseling and broaching. The most commonly used prior art process is the chiseling process, in which the grooved spark wheel is rotated while a chiseling tool or blade reciprocatingly cuts into the peripheral surface of the spark wheel as the spark wheel is rotated about its central axis. The chiseling process forms a plurality of substantially linearly arranged inclined teeth in the surface of the spark wheel. This, in combination with the grooves which have been previously cut into the spark wheel surface, produces the required abrasive surface for the spark wheel.

The second known process for producing spark wheels is disclosed in U.S. Pat. No. 2,455,348. As shown therein, the grooved cylindrical wheel is pushed through a broaching die to produce the desired abrasive surface for the spark wheel.

Both of these prior art methods are extremely disadvantageous, due to the expense required to produce an effective spark wheel. Repeated handling of the spark wheel during production is required in both processes, thereby increasing the production costs.

OBJECTS OF THE INVENTION

Therefore, it is a principal object of this invention to produce an effective abrasive spark wheel by an inexpensive manufacturing process.

Another object of the invention is to produce a spark wheel of the above character by a process that reduces the handling time and substantially increases automation.

Another object of this invention is to produce a spark wheel of the above character efficiently and rapidly.

Other objects of the invention will in part be obvious and will in part appear hereinafter.

SUMMARY OF THE INVENTION

By employing the process of this invention, unique spark wheels can be manufactured much more inexpensively than with prior art methods, due to increased manufacturing speed and minimization of labor involved in material handling. The principal manufacturing step in the process of this invention is rolling the grooved spark wheel blank between at least two dies through a sufficient number of revolutions to impart the desired abrasive surface to the spark wheel blank. The forming edges of the dies should be either substantially parallel or at an acute angle to the central axis of the spark wheel. The grooved spark wheel blank can be manufactured by any one of the various well-known methods.

In the preferred embodiment, a minimum of one revolution of the spark wheel across the roll-forming dies is employed in order to produce the desired abrasive surface on the peripheral surface of the spark wheel. One die is stationary, while the second die advances, causing the spark wheel to advancingly rotate between the dies. It is important to note that by employing the rolling process of this invention, the desired abrasive surface of the spark wheel is formed by the cooperating efforts of both dies acting upon the same surface. As the spark wheel rotates between the two dies, the cutting edges of the dies exceed the yield point of the spark wheel's material, causing the peripheral surface to deform, producing sharp edges and burrs throughout the entire spark wheel surface. This cooperative, overlapping surface deformation caused by the two dies allows the spark wheel to be produced rapidly with minimum labor cost.

The spark wheel incoroprates a plurality of raised teeth terminating with sharp edges and burrs at the highest point. Most of the teeth also incorporate a ramped, substantially flat top surface inclined upwardly toward the cutting edges and burrs. This unique surface construction after hardening, as is well known in the art, provides an extremely efficient spark wheel.

As inspection of the abrasive surface of the spark wheel shows that some raised teeth do not incorporate ramped, flat top surfaces. Instead, two raised teeth having sharp cutting edges and burrs have been formed in close proximity to each other. This dual tooth construction results from the overlapping forming action of two dies operating on the same peripheral surface of the spark wheel. This overlapping tooth-forming action is extremely important, since it increases the abrasive nature of the spark wheel. Furthermore, a spark wheel having this type of surface construction is not found in the prior art.

The spark wheel-forming teeth of the die incorporatate sharp edges which are formed at the intersection of an inclined ramp surface and a steeper burr-forming surface. In one embodiment of the die used in the rolling process of this invention, the burr-forming surface has an included angle with a plane perpendicular to the die of no greater than 12°. Also, it has been found that this burr-forming surface may be substantially perpendicular, having a zero degree angle, and if desired could be undercut. Furthermore, the sharp edges of the die should be spaced apart from each other a distance which prevents the rotating spark wheel blank from "bottoming out" or reaching the base of the burr-forming surface. If the spark wheel "bottoms out," or reaches the bottom intersection of the ramp surface and the burr-forming surface, the cutting edges and burrs of the spark wheel would be destroyed.

In another embodiment of the die used in the rolling process of the invention, it has been found that the die teeth may be spaced apart a distance which allows the spark wheel to bottom out on the inner surface, provided an additional undercut is included at the bottom surface. It has been found that this under-cut will prevent destruction of the sharp edges and burrs on the peripheral surface of the spark wheel, performing the same function as the more closely spaced die teeth discussed above.

It has also been found that any shaped die can be employed, namely a flat die or a cylindrical die. The only requirement is that at least two dies must be employed and the spark wheel must rotate between the edges for a sufficient revolution that will impart the desired abrasive surface to the spark wheel. By employing the rolling process of this invention, a very abrasive spark wheel surface is achieved inexpensively and rapidly, with little material handling required. As a result, the cost of the spark wheel is substantially reduced, with production quantities being substantially increased over the prior art systems.

The invention accordingly comprises the several steps and the relation of one or more such steps with respect to each of the others, and the apparatus embodying features of construction, combinations of elements and arrangements of parts which are adapted to effect such steps, all as exemplified in the following detailed disclosure, and the scope of the invention will be indicated in the claims.

THE DRAWINGS

For a fuller understanding of the nature and objects of the invention, reference should be had to the following detailed description, taken in connection with the accompanying drawings, in which:

FIG. 1 is a perspective view of a spark wheel manufactured by the process of the invention;

FIG. 2 is a top plan view of the abrasive surface of the spark wheel of FIG. 1;

FIG. 3 is a perspective view of a spark wheel blank with substantially parallel grooves formed in its outer peripheral surface;

FIG. 4 is a cross-sectional front elevation view of the spark wheel blank of FIG. 3 taken along lines 4—4 of FIG. 2;

FIG. 5 is a top plan cross-sectional view of a spark wheel being rolled between two dies;

FIG. 6 is a greatly enlarged side elevation view of one embodiment of a die used in the rolling step of the process of this invention;

FIG. 7 is a greatly enlarged cross-sectional side elevation view of another embodiment of a die used in the rolling step of the process of this invention;

DETAILED DESCRIPTION

Figure 8:
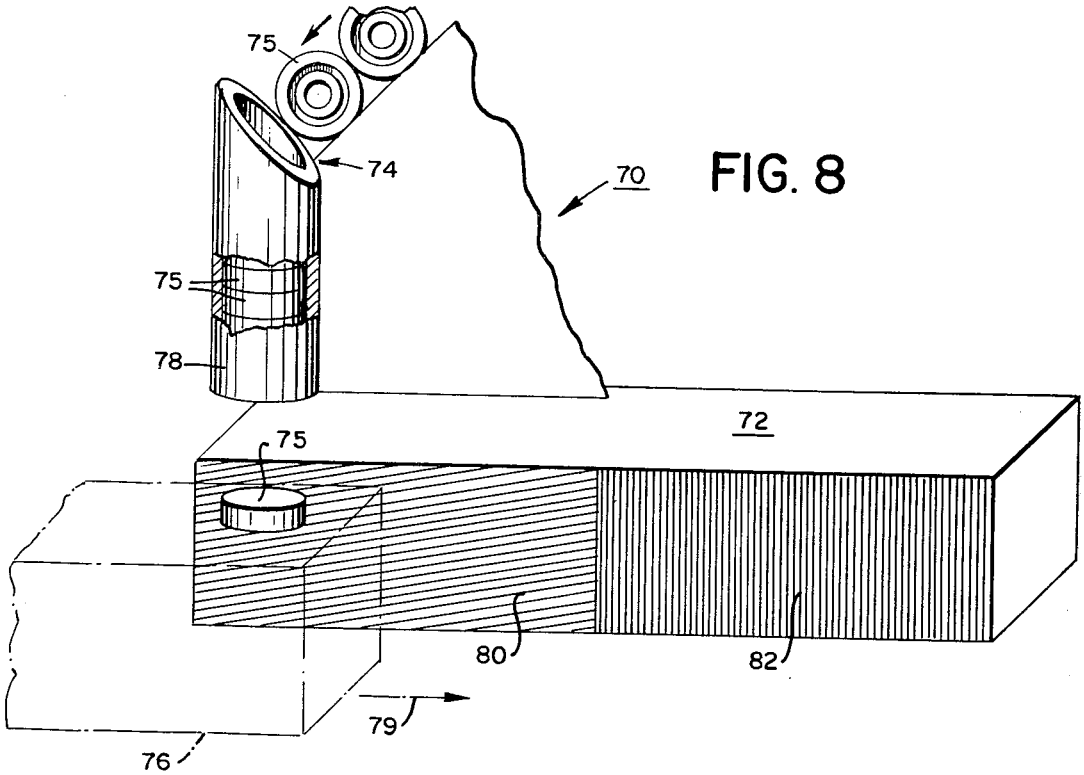
FIG. 8 is a perspective view of rolling and spark-wheel block feeding equipment employing another embodiment of a die for use in the process of this invention.

In FIG. 1, a spark wheel 20 manufactured by the process of this invention can best be seen. Spark wheel 20 comprises an abrasive outer peripheral surface 22, substantially flat sides 23 and 24, and an axial hole 25 generally used for mounting the spark wheel on a lighter.

In order for a spark wheel to effectively produce a spark when repeatedly frictionally rotated against a flint, or similar pyrophoric material, the surface of spark wheel 20 must be very abrasive. As shown in FIGS. 1, 2, and 5, the preferred abrasive surface 22 of spark wheel 20 has a plurality of raised teeth 26, each of which incorporates an upstanding sharp edge or burr 28. As best seen in FIG. 5, most of the raised teeth 26 incorporate a ramped, substantially flat top surface 27 terminating with a sharp edge or burr 28. Since the sharp edge or burr 28 is the highest point or raised tooth 26, sharp edge or burr 28 performs the desired cutting action on the flint to cause the sparking effect.

This preferred surface construction is extremely important in providing a spark wheel that will effectively and efficiently perform its desired function.

As shown in FIG. 5, some of the raised teeth 26 do not incorporate a ramped, flat top surface 27, and have instead been cut into two separate, closely spaced teeth 26, both of which incorporte sharp edges or burns 28. However, each tooth 26 incorporates two intersecting planar surfaces with a cutting edge or burr 28 extending from this intersection line at an angle which is not coincident with a plane bisecting the included angle formed by the intersecting planar surfaces. This surface construction is extremely important, since it increases the abrasive nature of surface 22, thereby providing an extremely effective spark wheel.

This preferred surface construction is not found in the prior art. Prior art spark wheels have either a cutting edge formed on each tooth at the intersection of two planes by a chiseling action, or have a single burr extending laterally from the teeth. Furthermore, one of the intersecting planar surfaces of the prior art spark wheels either lies along a radius of the spark wheel or has a point of this exposed surface lying alone a radius of the spark wheel. In the spark wheel of this invention, the included angle between the intersecting planar surfaces is larger than prior art spark wheels, thus producing an exposed surface that is not radial and does not have an exposed point lying along the radius of the spark wheel.

In order for spark wheel 20 to effectively and repeatedly cut a flint in a lighter and produce the required spark, each raised tooth 26 or group of teeth must be laterally offset from the raised tooth or group of teeth directly in front. If this were not the case, spark wheel 20 would merely create a groove in the flint and rapidly become inoperative. As a result, substantially parallel grooves 30, which are at an acute angle to sides 23 and 24, are formed in the peripheral surface of spark wheel 20 prior to the formation of raised teeth 26 and burrs and cutting edges 28.

It has also been discovered that spark wheel 20 with grooves 30 and abrasive surface 22 provides a spark wheel which substantially eliminates flint rotation. Consequently, clean repeated cuts of the flint are provided without binding of the spark wheel on the flint.

In FIGS. 3 and 4, the parallel grooves 30 formed in the peripheral surface of spark wheel 20 with lands 31 therebetween can best be seen. The particular pitch or number of grooves formed in the peripheral surface is a matter of design choice. The only requirement, as discussed above, is that grooves 30 must be at an acute angle to sides 23 and 24 of spark wheel 20. In the preferred embodiment, between 10 and 20 grooves or "starts" are formed in spark wheel 20. As shown in FIG. 4, a groove depth 32 of between 0.007 and 0.009 inches and a land width 34 of between 0.012 and 0.017 inches are preferred. However, a groove depth 32 of between about 0.002 and 0.020 inches and a land width 34 of between about 0.005 and 0.040 inches are effective. As is well known in the art, lands 31 are required since they provide the surface on which cutting teeth 26 are formed. The particular limitations indicated are merely design choices and in no way should be interpreted as limiting the scope of this invention.

Many processes for forming grooves 30 in a spark wheel blank are known in the art. One common method is completely disclosed in U.S. Pat. No. 2,455,348, in which the use of an automatic screw machine and a grooving tool is employed to form the desired grooves. Another well-known process is to form the grooves with a suitable die in an automatic screw machine, leaving peaks on the surfaces between the grooves, and then removing these peaks by means of a cutting tool while the spark wheel blank is still mounted in the automatic screw machine.

In the process of this invention, land portions 31 and grooves 30 are simultaneously formed at the desired angular pitch in the peripheral surface of a spark wheel blank. By forming both the grooves and the land portions in a single step at the desired angular pitch, a more efficient spark wheel is produced more quickly than with the prior art methods. In the prior art methods, the grooves and land portions are either produced substantially parallel to the sides of the spark wheel blank or are produced in two separate steps.

Figure 9:
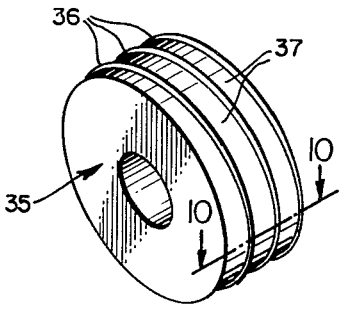
FIG. 9 is a perspective view of a groove and land forming tool for use in the process of this invention.
Figure 10:
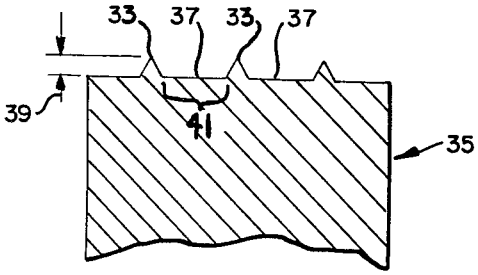
FIG. 10 is a cross-sectional elevation view of the forming tool of FIG. 9 taken along line 10—10 of FIG. 9.

The forming tool 35 for use in the process of this invention to simultaneously form grooves and lands is shown in FIGS. 9 and 10. Forming tool 35 incorporates groove-forming edges 33 and land-forming surfaces 37. It has been found that cutting tool 35 produces effective spark wheel blanks with distance 41 between forming teeth 33 of between about 0.005 and 0.040 inches with a forming tooth height 39 of between about 0.002 and 0.020 inches.

Forming tool 35 is employed in an automatic screw machine and, in one fast and efficient step, the advancement of tool 35 into the peripheral surface of a spark wheel blank forms both the grooves and the land portions at the desired skew angle.

Once the grooved spark wheel blank with the land portions therebetween has been formed, the next step is to form an abrasive surface on the grooved spark wheel blank. Using the process of this invention, abrasive surface 22 of spark wheel 20 is formed by rolling the grooved spark wheel blank between two cooperating dies 36 and 38, as shown in FIG. 5. In the preferred manufacturing process, die 38 is stationary, while die 36 advances in the direction shown by arrow 40. Spark wheel 20 is frictionally held between dies 36 and 38. As die 36 laterally moves in the direction indicated, spark wheel 20 rotates counterclockwise, as shown by arrows 42, while also laterally advancing in the direction indicated by arrow 40.

Although substantially flat dies are shown, any shaped die can be employed and, if desired, both dies can be in motion. The only requirement is that the die teeth must form the abrasive surface 22 on spark wheel 20. Spark wheel 20 can be rotated between the dies as many times as desired. However, it has been found that at least one complete revolution must be made in order to form the desired surface. In the preferred embodiment, between 2 and 3 revolutions of the spark wheel over the die surfaces are employed.

Using the process of this invention, the spark wheel-forming teeth of the two dies operate on the same surface of the spark wheel. This is completely different than any prior art process and produces an extremely abrasive spark wheel surface. By designing the spark wheel-forming teeth of the die to overlap their forming action on the same spark wheel surface, additional cutting teeth having sharp edges and burrs are formed. The result is a unique and extremely effective spark wheel.

As shown in FIG. 5, dies 36 and 38 incorporate a plurality of spark wheel-forming teeth 46. Each tooth 46 comprises an edge 48, a burr-forming surface 50, an inclined surface 52, and an inner groove 54.

It is important to note that burr-forming surface 50 of die 36 faces the opposite direction from burr-forming surface 50 of die 38. This die orientation is contrary to the teaching of prior art rolling methods. However, it has been found that unless the burr-forming surfaces of the two dies face in opposite directions, such as one towards the left and one towards the right, the desired abrasive surface on the spark wheel will not be produced.

In operation, a grooved spark wheel blank is positioned between dies 36 and 38 by gravity feed equipment, as shown in FIG. 8. With the grooved spark wheel blank frictionally engaged between dies 36 and 38, die 36 advances in the direction of arrow 40, causing the grooved spark wheel blank to rotate counterclockwise, as shown by arrows 42, while also advancing in the direction of arrow 40. When spark wheel 20 reaches the end of its travel across teeth 46 of dies 36 and 38, spark wheel 20 drops into suitable receiving equipment, well known in the art, and die 36 returns to its original position ready to repeat the same operation. In this manner, die 36 reciprocatingly advances, causing a grooved spark wheel blank to have the desired abrasive surface formed therein during each cycle, rapidly and efficiently with no manual labor required.

The edges 48 of dies 36 and 38 are positioned and maintained apart a distance 44, which allows grooved spark wheel 20, that is engaged therebetween, to be rolled across dies 36 and 38 without "bottoming out" on grooved surface 54. If dies 36 and 38 are too close together, the spark wheel surface will contact the grooved surface 54, causing cutting edges and burrs 28 to be broken off and rounded. This results in a spark wheel which does not cut the flint. As a result, it is important to maintain the particular distances 44 between dies 36 and 38, which will prevent bottoming out for that particular diameter spark wheel.

By employing at least two cooperating dies, an extremely unique abrasive surface 22 is formed on the spark wheel 20. As discussed above, the roll-forming process of this invention produces a plurality of sharp edges and burrs 28 throughout the entire peripheral surface of spark wheel 20. It is believed that during the rolling process, edges 48 of spark wheel-forming teeth 46 of dies 36 and 38 produce stress concentrations radially along the spark wheel which exceed the yield point of the spark wheel material. This causes the spark wheel surface to fracture and form sharp edges and burrs 28.

If the facing edges 48 of dies 36 and 38 are positioned directly opposite each other, surface 22 of spark wheel 20 would incorporate a plurality of teeth 26 with each having a ramp top surface 27 terminating in a cutting edge and burr 28. However, it has been found that this precise control is not required and edges 48 of dies 36 and 38 need not be directly opposite each other and in fact can incorporate different pitch angles.

By using dies 36 and 38 with spark wheel-forming teeth having different pitch angles or by having the teeth slightly offset from each other, teeth 46 are forced into ramped top surface 27 of spark wheel 20, causing additional cutting edges and burrs 28 to be formed, after the entire surface of spark wheel 20 has contacted at least one die. This is diagrammatically represented in FIG. 5, where edges 48 of die 36 are shown forming additional cutting edges and burrs 28 on spark wheel 20 during the rolling process. Also, the use of dies having identical pitch angles also produces this overlapping tooth-forming effect, since a 180°rotation of the spark wheel causes a reversal of the angle at which the cutting teeth on the spark wheel were initially formed.

Although one complete revolution of spark wheel 20 across die 36 and 38 would be sufficient to raise cutting teeth 26 having top portions 27 and cutting edges and burrs 28, by continuing the rolling process through additional revolutions of wheel 20, more sharp edges and burrs 28 are randomly formed where top portions 27 previously existed. The only requirement for forming additional cutting teeth 26 is that the additional cutting edge and burr-forming action of the dies must traverse at least one point along a previously formed row on surface 22 of spark wheel 20. This is best seen in FIG. 2, where the additional row 57 intersects the previous row 58 at point 59.

By employing this overlapping action, a spark wheel is produced which has a plurality of raised teeth randomly spaced through the peripheral surface of the wheel, while each raised tooth has a sharp cutting edge or burr. Furthermore, some of the raised teeth will have a ramp top surface extending up to the cutting edge or burr, while other teeth will not have the top surface. This spark wheel has a unique abrasive surface construction not found in the prior art, which is very effective due to the plurality of cutting edges and burrs.

In order to prove that the use of dies with teeth having different pitch angles consistently produces an abrasive surface 22 on spark wheel 20, many different types and combinations of dies were tested. It was found that all of the spark wheels produced in these tests were effective. As a result, it is believed that the number of cutting teeth per inch and the particular pitch angle employed is essentially a matter of design choice. However, it is important to note that the distance 60, between edges 48 of teeth 46, shown in FIG. 6, must be small enough to prevent spark wheel 20 from bottoming out on grooved surface 54. Also, distance 60 must be large enough to allow teeth 46 to produce enough radial stress on the spark wheel to exceed the yield point of the spark wheel material and cause sharp edges and burrs 28 to form. As a result, the preferred range of teeth per inch has been found to be between 20 and 60.

In the preferred embodiment, die 36 incorporates 32 teeth per inch with a left-hand helical orientation, while die 38 incorportes 32 teeth per inch with a substantially straight orientation, substantially parallel to the axis of spark wheel 20. Although this particular combination of dies is preferred, it is not intended in any way to limit the scope of the invention.

Another important feature of dies 36 and 38 is the included angle 61 that burr-forming surface 50 has with a plane perpendicular to the die. In the preferred embodiment, this included angle 61 is about 3°, although angles between zero and 12 degrees have been found to be equally effective. If angle 61 is too great, burr-forming surface 50 of the dies will have the effect of dulling or rounding the cutting edge and burrs 28 as spark wheel 20 rotatingly advances beyond that particular tooth. As a result, it is important to control angle 61 in this embodiment of the die, maintaining it within the preferred limits.

Another embodiment of a die 64 for use in the rolling process of this invention is shown in FIG. 7. As with dies 36 and 38, die 64 incorporates an edge 48, a burr-forming surface 50, and as inclined surface 52. The major variation in die 64 is the incorporation of a channel 66 at the base of surface 50 extending the entire length of surface 50. It has been found that by incorporating channel 66, dies 64 could be positioned more closely together than with dies 36 and 38 without fear of rounding or dulling cutting surfaces and burrs 28 by bottoming out.

Preferably, channel 66 is about 0.006 inches wide and 0.010 inches deep. By employing die 64 with channel 66 incorporated therein, the distance 44 between edges 48 need not be precisely controlled and the distance 60 between teeth 48 of the particular die can be substantially increased.

In FIG. 8, typical rolling and feeding equipment 70 is shown with another embodiment of a die 72 incorporated therein. Rolling and feeding equipment 70 incorporates gravity feeding and holding means 74 for receiving spark wheel blanks 75 and positioning them in the proper orientation ready for gravity feed between the cooperating dies 72 and 76.

In operation, when die 76 is in the start position as shown in FIG. 8, spark wheel blank 75 is dropped from holder 78 to a position between dies 72 and 74. Then, reciprocating die 76 advances in the direction of arrow 79, rotatingly advancing spark wheel blank 75 between cooperating dies 72 and 76. When die 76 has reached the end of its travel, the produced spark wheel is dropped into receiving means, not shown, and die 76 returns to the start position.

Die 72 is another embodiment of the dies of this invention. Die 72 incorporates two separate die surfaces 80 and 82. Die surface 80 comprises a plurality of teeth positioned for producing the desired flat-topped grooved surface on the peripheral surface on the peripheral surface of spark wheel blank 75, while die 82 is similar to the dies discussed above for producing the desired abrasive surface. The spark wheel blanks 75 for use with this combination die can be quickly and easily produced, using stamping presses, headers, or screw machines, well known in the art.

By employing the combination die 72, a spark wheel can be produced in one fast and efficient step with a minimum labor requirement. Die surface 80 quickly and efficiently imparts the desired flat-topped grooved surface having the desired orientation, while surface 82 provides the abrasive surface required for an effective spark wheel. Die 76, which is shown in phantom, would incorporate cooperating die surfaces similar to surfaces 80 and 82 constructed in a manner which would cooperate with the particular rolling operation being performed at a particular time.

By employing the process of this invention and any of the particular dies disclosed herein, a spark wheel having a unique surface construction can be produced rapidly and efficiently with minimum labor requirements. As a result, the spark wheel will be extremely less expensive than prior art spark wheels, thus filling a long-needed gap in the industry. As is obvious to one skilled in the art, any spark wheel produced by the process of this invention must be hardened before being employed in a lighter. As is well known in the art, the spark wheel material employed during the production process is not hard enough to repeatedly cut the flint in a lighter and, as a result, must be hardened before being so used.

It will thus be seen that the objects set forth above, among those made apparent from the preceding description, are effectively attained and, since certain changes may be made in carrying out the above process, in the described product, and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A process for manufacturing spark wheels having a substantially cylindrical shape, comprising the steps of:

A. forming a plurality of spaced grooves in the outer peripheral cylindrical surface of said spark wheel with land portions there-between, each of said grooves being at an acute angle to the sides of said wheel; and B. rolling the grooved spark wheel between at least two dies having spark wheel-forming teeth extending transversely to said grooves for forming throughout the peripheral cylindrical surface of the sparkwheel a plurality of raised teeth having sharp cutting edges and burrs.

2. The process defined in claim 1, wherein one of said dies is stationary and the other of said dies reciprocatingly advances in a direction coincident with the overall plane of its spark wheel-forming teeth.

3. The process defined in claim 1, wherein during said rolling step, the grooved spark wheel rotates about its own axis between said dies for at least one complete revolution.

4. The process defined in claim 1, wherein each of the spark wheel-forming teeth of the dies comprises a burr-forming edge, an inclined surface, and a burr-forming surface terminating at an intersection with said inclined surface to form said burr-forming edge, and said burr-forming surface is further defined as comprising an included angle with a plane perpendicular to said die of no greater than 12 degrees.

5. The process defined in claim 4, wherein the burr-forming surfaces on one of the dies face in the substantially opposite direction from the direction which the burr-forming surfaces of the other die face.

6. The process defined in claim 4, wherein the burr-forming edges of each of said dies are positioned apart a distance less than the overall diameter of said spark wheel with said distance being great enough to prevent bottoming out of the formed cutting edges and burrs of said spark wheel.

7. The process defined in claim 1, wherein said dies are further defined as comprising between about 20 and 60 burr-forming teeth per inch.

8. The process as defined in claim 1, wherein said burr-forming teeth of said cooperating dies provide an overlapping action on the same surface of said spark wheel, intersecting at at least one point of a previously formed row of raised teeth.

9. The process defined in claim 1, wherein said spaced grooves and said land portions are formed in a screw machine in a single step employing a groove and land-forming tool comprising:

a. a substantially cylindrical shape, and b. raised groove-forming teeth 1. at an acute angle to the sides of said tool,
2. extending above the peripheral surface of said tool a distance of between about 0.002 and 0.020 inches, and
3. spaced apart a distance of between about 0.005 and 0.040 inches.

10. A process for manufacturing spark wheels from stock material comprising the steps of:

A. blanking a substantially cylindrical spark wheel blank with substantially flat ends;

B. forming a plurality of spaced grooves in the outer peripheral surface of said spark wheel blank with each of said grooves being at an acute angle to the ends of said spark wheel blank; and C. rolling the grooved spark wheel blank between at least two dies having spark wheel-forming teeth extending transversely to said grooves forming the spark wheel with a plurality of sharp cutting edges and burrs on its outer peripheral cylindrical surface.

11. A roll-forming die for successively manufacturing a plurality of raised flint-cutting teeth on the surface of a spark wheel comprising a plurality of upstanding forming teeth, extending from the die surface, each of said upstanding teeth adapted for forming a separate flint-cutting tooth on the spark wheel surface as the spark wheel moves across the upstanding teeth for said successive production of the flint-cutting teeth, and each of said upstanding teeth and comprising:

A. a forming surface extending from the die surface for raising the flint-cutting tooth on the spark wheel;

B. an inclined surface, ramped upwardly from the base of the adjacent forming surface, incorporating a pitch angle for preventing bottoming out of said flint-cutting tooth of said spark wheel with the die surface;

C. a forming edge, located at the intersection of said inclined surface and said forming surface for penetrating the spark wheel surface and establishing a flint-cutting tooth thereon; and D. an included angle between said forming surface and a plane intersecting said tooth perpendicularly to the die surface of between zero and 12°, thereby preventing dulling contact between said forming surface and said raised flint-cutting tooth of the spark wheel, as the spark wheel surface advances to the next die tooth.

12. A die as defined in claim 11 comprising between about 20 and 60 forming teeth per linear inch.

13. A die as defined in claim 11 comprising 32 forming teeth per linear inch.

14. A die as defined in claim 11, wherein said forming teeth comprise a substantially zero pitch angle.

15. The die as defined in claim 11, wherein said forming teeth comprise a left-handed helical pitch angle.

16. The die as defined in claim 11, wherein said forming teeth comprise a right-hand helical pitch angle.

17. A tool for forming burrless grooves, in the peripheral surface of a spark wheel comprising:

A. a substantially circular cylindrical shape, and

B. radially raised groove-forming teeth in the form of helical ridges about said cylindrical shape, said teeth a. comprising two surfaces each at an acute angle to the sides of the tool, and b. extending above said cylindrical shape of said tool a distance of between about 0.002 and 0.020 inches, and C. material flow-controlling spacing surfaces extending between said raised groove-forming teeth for compressing and flattening any burrs produced during the groove formation, simultaneously with said groove formation, each of said spacing surfaces comprising an axial distance a. between about 0.002 and 0.040 inches, and b. at least equal to the height of said groove-forming teeth above said cylindrical shape, whereby any burrs produced by said groove-forming teeth are compressed and flattened into the peripheral surface of the spark wheel simultaneously with the formation of the grooves, thereby providing a spark wheel having a helical groove formed in its peripheral surface and separated by burrless flat lands, simultaneously formed therewith.

18. The tool defined in claim 17, wherein the height of said forming teeth is about 0.007 and 0.009 inches and said separation distance is about 0.012 and 0.017 inches.

19. The tool defined in claim 17, wherein said tool comprises a plurality of substantially parallel raised forming teeth.

* * * * *